United States Patent [19]

Vogel

[11] Patent Number: 4,569,299

[45] Date of Patent: Feb. 11, 1986

[54] STITCH LENGTH AND WIDTH ADJUSTING LINKAGE

[75] Inventor: Peter Vogel, Steckborn, Switzerland

[73] Assignee: Fritz Gegauf Aktiengesellschaft Bernina-Nahmaschinenfabrik, Steckborn, Switzerland

[21] Appl. No.: 671,922

[22] Filed: Nov. 15, 1984

[30] Foreign Application Priority Data

Dec. 27, 1983 [CH] Switzerland ..... 6939/83

[51] Int. Cl.[4] ..... D05B 3/02

[52] U.S. Cl. ..... 112/315; 112/464

[58] Field of Search ..... 112/315, 158 A, 158 D, 112/316, 158 R

[56] References Cited

U.S. PATENT DOCUMENTS 2,172,559 9/1939 Kaier ..... 112/316

3,479,977 11/1969 Meier ..... 112/158 R 4,501,213 2/1985 Meier ..... 112/316

*Primary Examiner*—Werner H. Schroeder

*Assistant Examiner*—Andrew M. Falik

*Attorney, Agent, or Firm*—Birch, Stewart, Kolasch & Birch

[57] ABSTRACT

A connecting link for setting stitch width or length is fashioned as a flat metal piece and is retained on the bearing side in a molded-on synthetic resin bearing head. The bearing head is suspended by means of two trunnions on a bearing bracket and on an index lever attached to the bearing bracket. The sliding block is constituted by a sliding sleeve made of a synthetic resin, encompassing the connecting link and articulated by way of two trunnions to the linkage leading to the needle bar frame.

6 Claims, 5 Drawing Figures

9
8
7
5a
5e
5
5b
10
11a
11
11b
4
2
3a
4b
3

5a
5
5e
8
5d
5d
5b
8
5c
5c
7
4
4b 5d
5
5e
5b
4
5d 10c
10b
10a
10
10c

STITCH LENGTH AND WIDTH ADJUSTING LINKAGE

BACKGROUND AND SUMMARY OF THE INVENTION

The present invention relates to a device in a sewing machine with a connecting link for setting the stitch width or the stitch length.

The basic principle of zigzag control by means of a link and of stitch displacement by a shift of the zero point at the link fulcrum is apparent from Renter's "The Sewing Machine Specialist," Vol. III, Pages 14 and 15.

Thus, devices for setting the stitch width are conventional. They comprise in most cases a linear or curved connecting link exhibiting on one side a guide track for a sliding block, designed as an open groove, and on the other side thereof the bearing permitting a pendulum motion of the connecting link. In devices of this type serving for setting the stitch width, the connecting link suspension is adjustable in correspondence with the desired stitch area position (left-center-right). The connecting link can be driven, for example, by way of an eccentric or a cam disk while the sliding block can transmit its movement via a tie rod to the needle bar frame. The connecting link of such a setting device must be manufactured and supported with extreme accuracy, since any inaccuracies that may exist will have a direct effect on the sewing result. Therefore, it has been suggested to manufacture the connecting link and the sliding block of a synthetic resin for the purpose of reducing not only the manufacturing costs but also the mass to be moved. However, the unilateral support of the connecting link still has remained a disadvantage, leading also in the case where the connecting link is made of a synthetic resin, to distortions due to a correspondingly asymmetrical application of force.

Therefore, the present invention is based on the object of providing a device of the type discussed above wherein this disadvantage is eliminated, and the bearing of the connecting link and the guidance of the sliding block are selected so that the force of transmission takes place in the plane of symmetry of the connecting line, and lateral forces leading to distortions are avoided.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The device of the present invention is characterized in that the connecting link is a flat member, the end portion of this member on the bearing side being disposed in a bearing head which in turn is pivotably supported on a support by means of two trunnions arranged symmetrically to the central plane of the flat member and extending away at right angles to the flat sides of this flat member. The sliding block is fashioned as a sliding sleeve displaceably guided on the flat member and encompassing the latter.

Since, on the one hand, the connecting link is bilaterally supported and, on the other hand, the sliding block encompasses the connecting link on all sides, the force input at the connecting link bearing, just as the force output by the sliding block, occur in the center plane of the connecting link designed as a flat member, so that it is practically impossible for lateral forces to arise, which would lead to distortions.

In an especially advantageous embodiment, the connecting link consists of a flat member of metal, for example steel or aluminum, advantageously produced by stamping, whereas the bearing head is made of a synthetic resin. However, it is also possible for both parts to be made of steel, or for both to be made of a synthetic resin, in which case they can consist of one piece, for example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
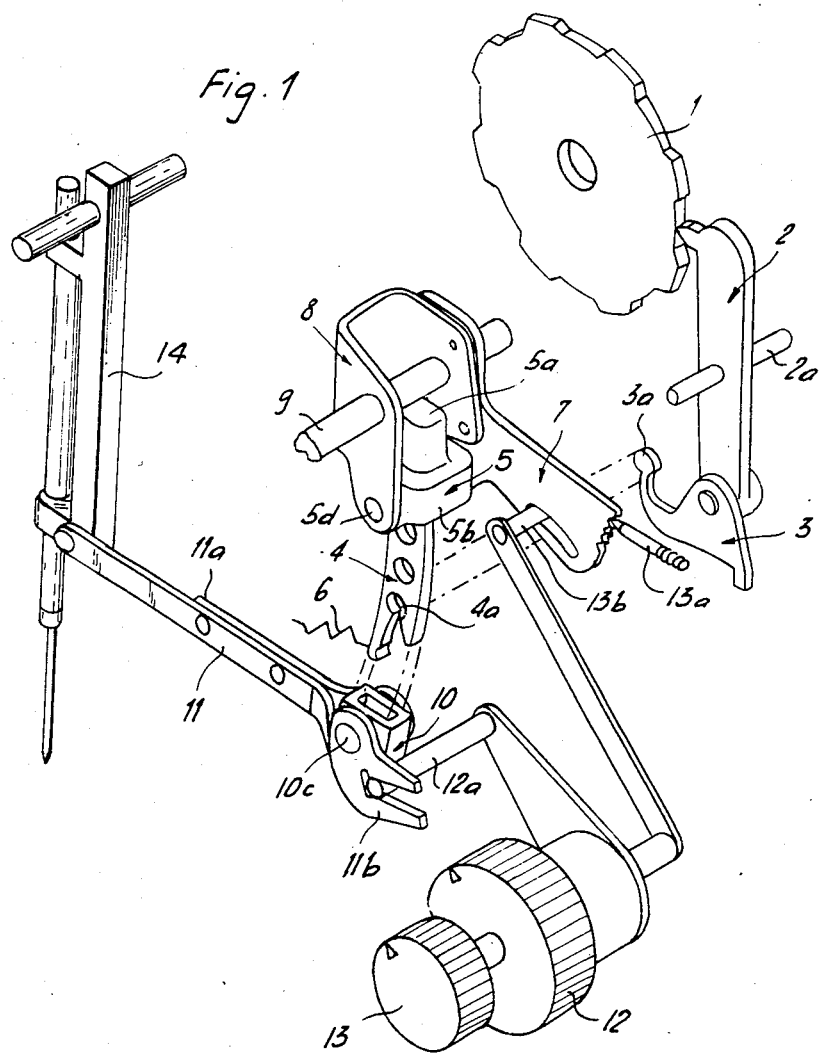
FIG. 1 shows in a diagrammatic and partially exploded view of the device of the present invention.
Figure 2:
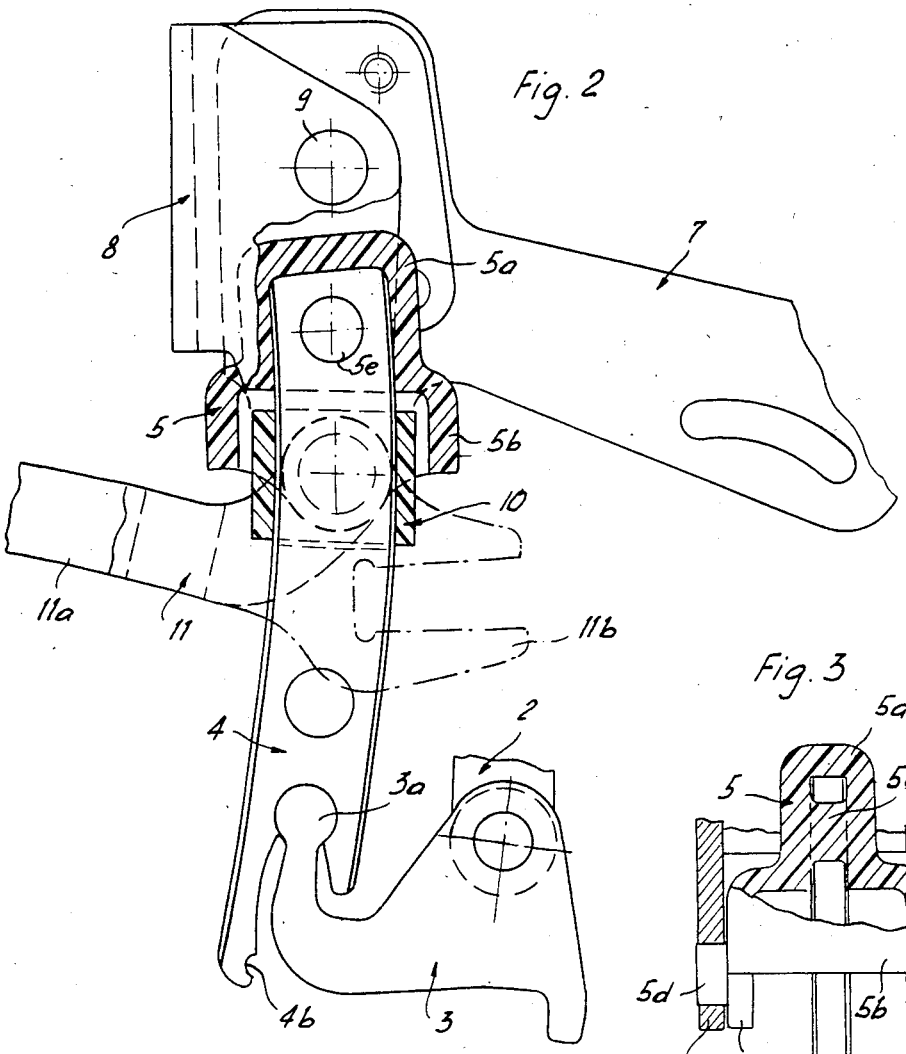
FIG. 2 shows a lateral view of the device of the present invention, partially in section and broken away, respectively.
Figure 3:
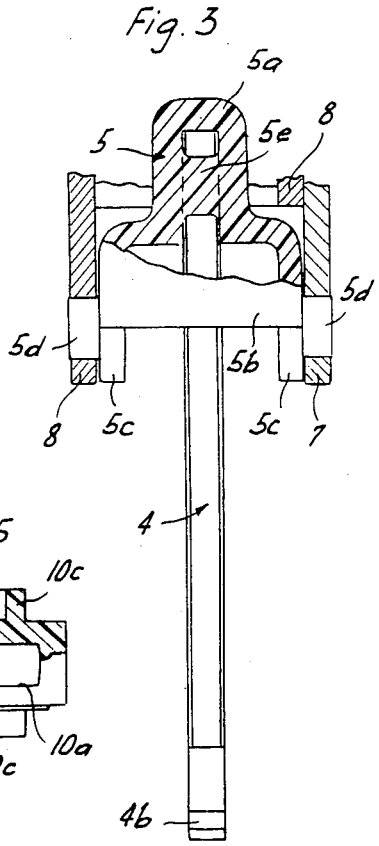
FIG. 3 shows a top view of the connecting link and the bearing head, partially in section.
Figure 4:
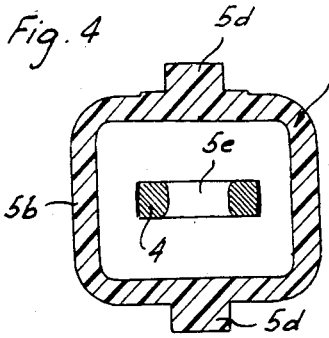
FIG. 4 is a cross section through the bearing head with the connecting link inserted.
Figure 5:
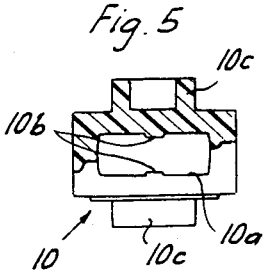
FIG. 5 is a view of the sliding block partially in section.

In FIG. 1 of the drawings, element 1 denotes the drive cam disk. One end of a key lever 2 pivotable about a fixed axle 2*a* cooperates with this drive cam disk. A transmission fishplate 3 is engaged to the other end of the key lever. A partially cylindrical driving nose 3*a* engages in a corresponding bearing recess 4*a* open toward the end of the connecting link and provided on an end portion of the connecting link 4, constituted by a curved, flat metal piece. The narrow sides of the connecting link 4 are cambered in cross section. The other end of this connecting link 4 is firmly seated in the mounting element 5*a* of a bearing head 5. This bearing head 5, formed of a molded part made of a synthetic resin, exhibits, following the mounting element 5*a*, a collar 5*b* surrounding the adjacent portion of the connecting link 4 with a spacing. The collar walls in parallel to the flat sides of the connecting link 4, and extending with arcuate projections 5*c* past the two other collar walls, are each provided on the outside with a trunnion 5*d*. The two trunnions 5*d* extend at equal distances on both sides of the plane of symmetry of the connecting link 4 and at right angles to this plane, away from the collar walls. The mounting element 5*a* of the bearing head 5 penetrates a cutout 4*b* of the connecting link 4 with a web 5*e* so that a perfect anchoring of the connecting link 4 in the bearing head 5 is ensured. As can be seen from FIGS. 1 and 2, the connecting link 4 is provided with additional cutouts serving for weight reduction, but these could also be omitted. A draw spring 6, stressing the connecting link toward its one end position, engages at a terminal hook 4*b* of the connecting link 4. One of the two trunnions 5*d* serving for suspension of the connecting link is supported in a bearing eye of an index lever 7, which latter is fixedly connected to one leg of a supporting bracket 8 while the other trunnion 5*d* is supported in the other leg of the supporting bracket 8. The supporting bracket 8 proper is seated on a bearing axle 9, stationarily mounted in the machine. A sliding block 10, designed as a sliding sleeve, is arranged to be longitudinally displaceable on the connecting link 4. The aperture 10*a* of the sliding block 10 is provided on the narrow sides to the cambered narrow sides of the connecting link, while one central rib 10*b*, exactly adapted to the thickness of the connecting link, is provided on the broad sides of the aperture 10*a*, which latter is somewhat widened with respect to the thickness of the connecting link 4. Consequently, an exact, jam-free guidance of the sliding block 10 on the connecting link 4 is ensured. The trunnion 10*c* is arranged on the respective outer flat sides of the sliding block 10. By means of these trunnions, the sliding block 10 is articulated to a tie rod 11 and/or to a fishplate 11*a* fixedly joined to the tie rod. The cross-sectional dimensions of the sliding block 10 are selected so that the sliding block fits into the cutout provided by the collar 5*b* of the bearing head 5, namely to such an extent that, in its innermost position shown in FIG. 2, its trunnions 10*c* are in alignment with the trunnions 5*d* of the bearing head 5. This requires, as can be seen from FIGS. 1 and 2, a corresponding protrusion of the articulation points at the fishplate 11*a* and at the tie rod 11. The tie rod 11 leads to the needle bar frame 14 of the sewing machine. The stitch width adjustment can take place in a manner known per se via the cross pin 12*a* engaging the tie rod fork 11*b* and operable by means of the turning knob 12 while, in the illustrated example, the index lever 7 cooperating with a spring-leaded detent pin 13*a*, and thus the connecting link suspension, is adjustable for setting the stitch-filled position by way of a cross pin 13*b* engaging into a slot of this lever 7 and operable by means of a turning knob 13.

Thanks to the bilateral supporting of the plastic bearing head 5 holding the connecting link 4, and by virtue of the fact that the sliding block 10, suitably consisting of a synthetic resin, completely encompasses the connecting link 4 designed as a flat member, as well as thanks to the bilateral engagement of the tie rod 11 and the fishplate 11*a*, respectively, at the sliding block 10, symmetrical to the center plane of the connecting link 4, a force action in the connecting link is ensured which is completely symmetrical with respect to the center plane of the connecting link, and undesirable transverse forces are avoided.

With reference to FIG. 1 of the drawings, in operation the link 4 oscillates under the influence of the cam 1 about the fulcrum 5*d*. The sliding block 10, which can slide on the link 4 is connected to the needle-bar oscillating frame via the draw bar 11 in order to transmit the oscillating motion of the link 4 to the frame. The stitch-width adjustment is achieved by sliding the sliding block 10 on the link 4, namely, during the rotation of the adjustment knob 12 about its axis. In the process, the pin 12*a* shifts the fork 11*b* connected to the sliding block 10. The fork 11*b* is necessary so that the pin 12*a* remains connected to the sliding block 10 in any position of the sliding block on the link 4, because the movements of the sliding block 10 on the link 4 and of the pin 12*a* are incongruent with each other.

Exactly the same holds true for the actuating lever 7 and the pin 13*b*, which engages in a slot of this lever 7. When the adjusting knob 13 is turned so as to vary the stitch-field position, the pin 13*b* shifts the actuating lever 7 about the axis of rotation 9. In this way the position of the link fulcrum 5*d* is also displaced, which, depending upon the direction of rotation of the knob 13 causes the stitch position to be shifted to the left or right. Analogous to the fork 11*b*, the sole task of the slot in the actuating lever 7 is to facilitate the relative movement occurring between pin 13*b* and actuating lever 7 when setting the stitch-field position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device in a sewing machine including a connecting link for setting the stitch width or stitch length, characterized in that said connecting link is a flat member, the end portion of which, on the bearing side, is mounted in a bearing head, the latter being pivotably disposed on a support by means of two trunnions arranged symmetrically to the center plane of the flat member and extending away at a right angle to the flat sides of the flat member, and a sliding block fashioned as a sliding sleeve and displaceably guided on said flat member and encompassing the latter.

2. The device according to claim 1 wherein said connecting link is stamped from a metal, a mounting element of said bearing head being molded to the end of the stamped metal on the bearing side, said bearing head comprising a collar, spaced apart from but surrounding said connecting link, the trunnions being provided at said collar.

3. The device according to claim 2 wherein the end of said connecting link facing away from the end on the bearing side comprises a bearing recess into which is engaged a cylindrical nose of a transmission fishplate drivable by a key lever and a cam disk.

4. The device according to claim 2 wherein a narrow side of the connecting link is cambered in cross section, and corresponding inner narrow sides of said sliding block conform to this camber, whereas inner flat sides of said sliding block include a longitudinal rib in contact with flat sides of said connecting link.

5. The device according to claim 4 wherein said sliding block has associated therewith two aligned trunnions which are disposed axially parallel to the trunnions of the bearing head, a linkage engaging these trunnions symmetrically to the center plane of said connecting link, said linkage conveying the movement of said sliding block determining the stitch width or stitch length.

6. The device according to claim 5 wherein a fishplate engages with a trunnion of said sliding block, said fishplate being attached to a tie rod engaging another trunnion of said sliding block and being connected with respect to its movement with the needle bar frame of the sewing machine, the sliding block being displaceable on the connecting link by way of the tie rod by means of a turning knob for the purpose of setting the stitch width.

* * * * *